US006685345B1

(12) United States Patent
Velasquez

(10) Patent No.: US 6,685,345 B1
(45) Date of Patent: Feb. 3, 2004

(54) CONVERTIBLE CANDLE LAMP AND METHOD

(76) Inventor: Theresa Velasquez, 1934 Manning Rd., Darien, IL (US) 60561

( * ) Notice: Subject to any disclaimer, the term of this patent is extended or adjusted under 35 U.S.C. 154(b) by 0 days.

(21) Appl. No.: 10/145,330

(22) Filed: May 15, 2002

(51) Int. Cl.[7] ..... F21V 35/00; F21V 11/00
(52) U.S. Cl. ..... 362/392; 362/356; 362/810
(58) Field of Search ..... 362/161, 351, 362/353, 355, 356, 361, 392, 393, 810

(56) References Cited

U.S. PATENT DOCUMENTS 1,594,138 A * 7/1926 Wischhusen et al. ..... 362/252
3,748,464 A * 7/1973 Andeweg ..... 362/355
3,749,904 A * 7/1973 Graff ..... 362/265
3,762,857 A * 10/1973 Andeweg ..... 431/253
3,890,085 A * 6/1975 Andeweg ..... 362/161
4,731,718 A * 3/1988 Sheu ..... 362/392
5,791,774 A * 8/1998 Briles ..... 362/392
6,196,706 B1 * 3/2001 Cutts ..... 362/392

* cited by examiner

*Primary Examiner*—Alan Cariaso
(74) *Attorney, Agent, or Firm*—The Law Office of Barbara R. Greenberg

(57) ABSTRACT

A convertible candle lamp and method including a solid wax cylindrical encasement element having a translucent wall embedded with decorative objects and a solid wax base provided with illumination means including an external electrical source, a battery operated source and a candle source to give the convertible candle lamp an appearance of a glowing candle. A method of fabricating the convertible candle lamp is described.

3 Claims, 4 Drawing Sheets

Fig. 1
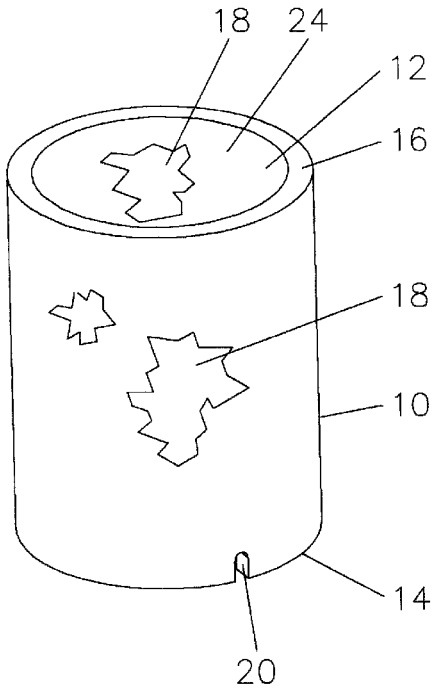
Fig. 2
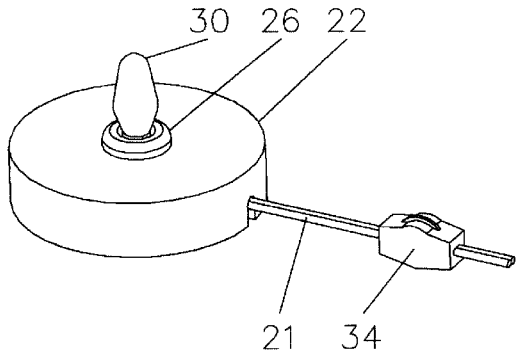
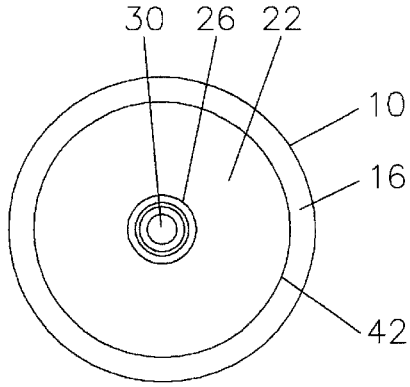
Fig. 5
Fig. 4
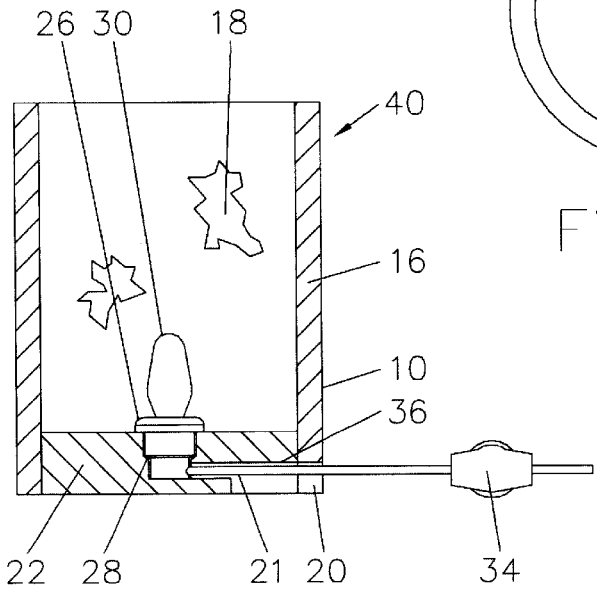

Fig. 6
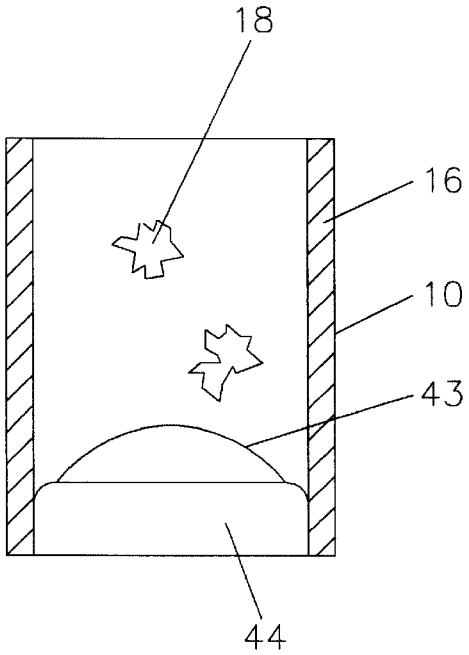
Fig. 7
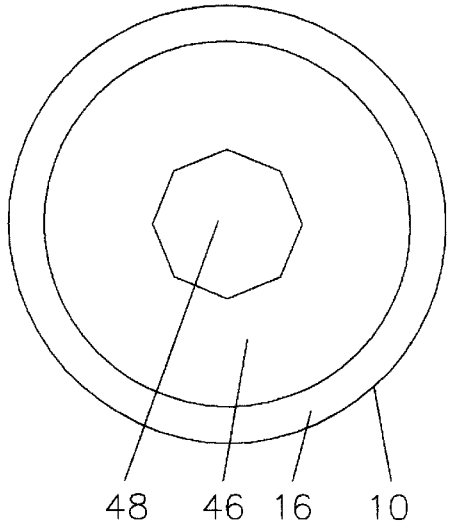
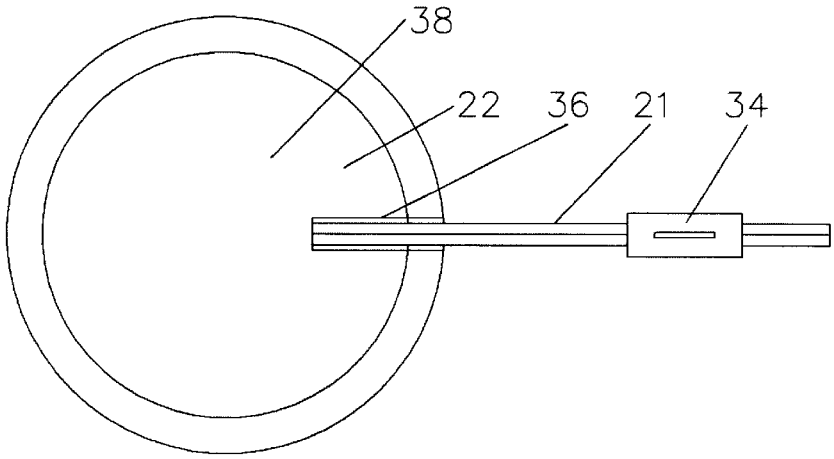
Fig. 3

CONVERTIBLE CANDLE LAMP AND METHOD

This invention relates to electronic candle emulating lamps and, more specifically, to a convertible candle lamp having battery operated, electrical outlet operated or candle operated lighting means and a method for producing the lamp.

BACKGROUND OF THE INVENTION

Wax candles with open flames have been used for centuries as light sources, for their warming properties or simply for their esthetic value. However, candles with open flames present safety hazards. An open flame can ignite nearby burnable objects. It can emit hazardous products of incomplete combustion such as carbon monoxide and carbon black particles. Candle wax can drip and mar a candle holding surface. In addition, a candle's life is limited by the candle's size.

Candle lamps are well known and described in the following U.S. patents:

U.S. Pat. No. 3,749,904 issued to R. A. Graff describes small wattage light bulbs potted in a wax form to make a candle lamp. The small wattage and thick wax form surrounding the light bulbs limit light emission from the lamp.

U.S. Pat. No. 3,761,702 issued to F. J. Andeweg teaches an internally illuminated candle positioned in an enclosed cavity. The enclosed cavity can store heat presenting a potential fire hazard.

U.S. Pat. No. 3,762,857 issued to F. J. Andeweg describes an internally illuminated candle positioned in an enclosed cavity with a rotatable transparent material or a media player mounted in a candle mount base. The enclosed light source as in U.S. Pat. No. 3,761,702 still presents a potential fire hazard.

U.S. Pat. No. 3,890,085 issued to F. J. Andeweg continues to exhibit a light source entirely enclosed in a wax body subject to heat build up.

In U.S. Pat. No. 6,017,139, a candle is simulated with electronic switching and timing means. There is no wax casing to diffuse light and thus provide an esthetically pleasing candle appearance.

The present invention convertible candle lamp comprises an open decorative light diffusing candle wax encasement that provides for lamp base electrical outlet lighting means which are convertible to internal battery operated lighting means. The battery operated lighting means allows lamp portability including convenient indoor and outdoor use. In addition, in the battery operated mode, esthetically unpleasant wires and switches are eliminated. Also, a user can switch the candle lamp from battery operated lighting means to electrical outlet operating means in a few minutes. A simple push slides the battery operated lighting means out of the candle wax encasement to be replaced instantly with the electrical outlet lighting means. A third means for providing a light source is by placing a candle such as a votive candle or tealight within the light diffusing candle lamp encasement A principle objective of the present invention is to provide a new and useful lamp comprising a candle simulating wax encasement with electrical outlet, battery operated and candle lighting means.

Another objective of the invention is to provide a not only safe but esthetically beautiful source of light.

Still another objective of the invention is to provide a candle emulating lamp that is environmentally friendly.

Yet another objective of the invention is to teach a method of fabricating the present invention.

SUMMARY OF THE INVENTION

Generally, the present invention comprises a candle emulating lamp having a wax, open ended encasement element fitted to accept an internally battery operated light source, such as a push lamp, an electrical outlet light source such as a clear, low wattage light bulb, or a burning candle light source. The light bulb can be contained in a light socket which is embedded in a solid wax lamp base insert element designed to slip easily into the wax encasement element and slightly touch the wax encasement inner surface so some adhesion between the touching wax surfaces occurs. The candle light source can be a votive candle that is placed on a ceramic tile piece inserted on a solid wax lamp base insert element. No matter which light source is used, the wax candle lamp encasement provides a translucent medium for light transmission so that a viewer perceives the lamp as a burning candle. The convertible candle lamp provides burning candle beauty with permanent endurance in a safe environment.

Included in a detailed description of the invention below is a method for fabricating the convertible candle lamp.

SHORT DESCRIPTION OF THE DRAWINGS

FIG. 1 is a front perspective view of a convertible candle lamp wax encasement element.

FIG. 2 is a front perspective view of a convertible candle lamp solid wax base insert element having electrical lighting components.

FIG. 3 is a bottom view of a convertible candle lamp solid wax base insert element showing electrical cord placement.

FIG. 4 is a longitudinal sectional view of a convertible candle lamp wax encasement element as shown in FIG. 1 assembled with a solid wax base insert element as shown in FIG. 5 is a top view of a convertible candle lamp having electrical outlet lighting components.

FIG. 6 is a longitudinal sectional view of a convertible candle lamp wax encasement element having a battery operated light source.

FIG. 7 is a top view of a solid wax base insert element with a top surface ceramic tile.

DETAILED DESCRIPTION OF THE INVENTION

Figure 8:
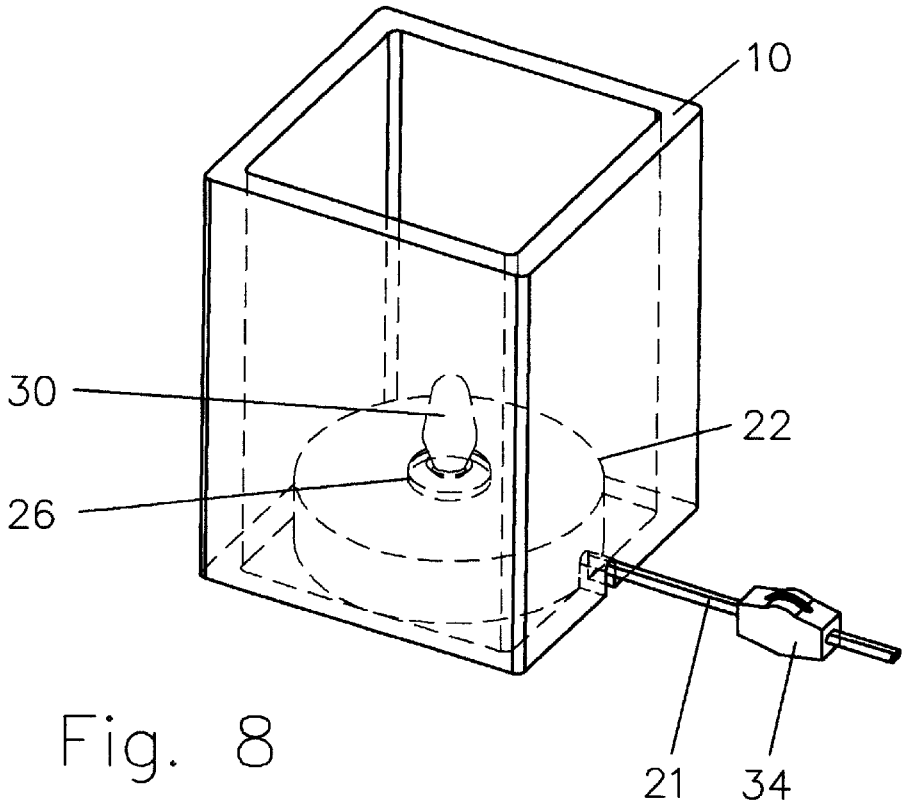
FIG. 8 is a front perspective view of a tetrahedral candle lamp wax encasement element.
Figure 9:
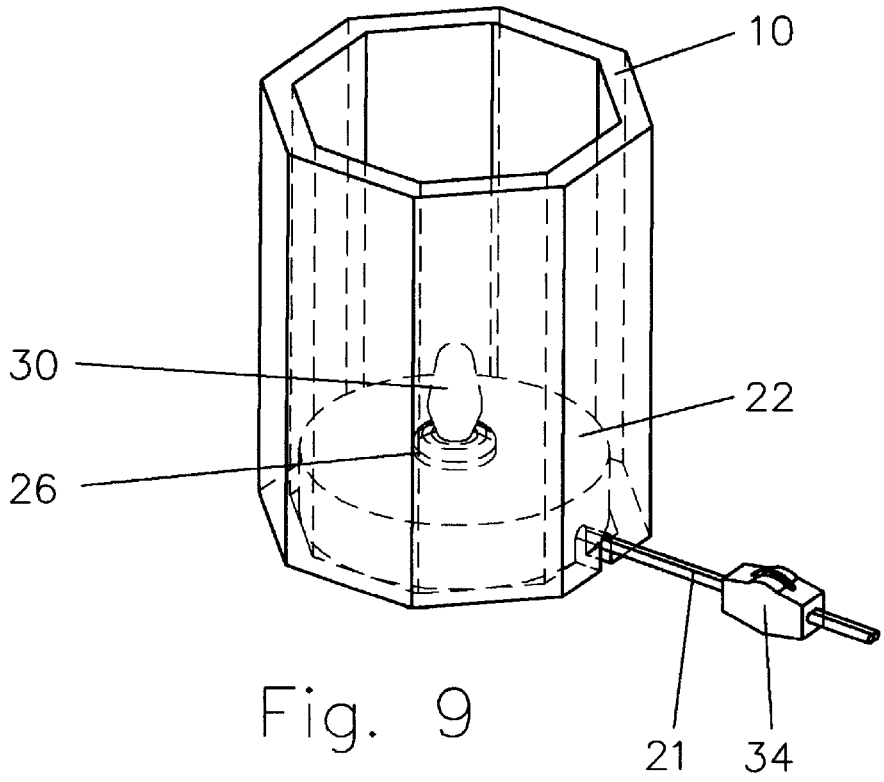
FIG. 9 is a front perspective view of a polyhedral candle lamp wax encasement element.
Figure 10:
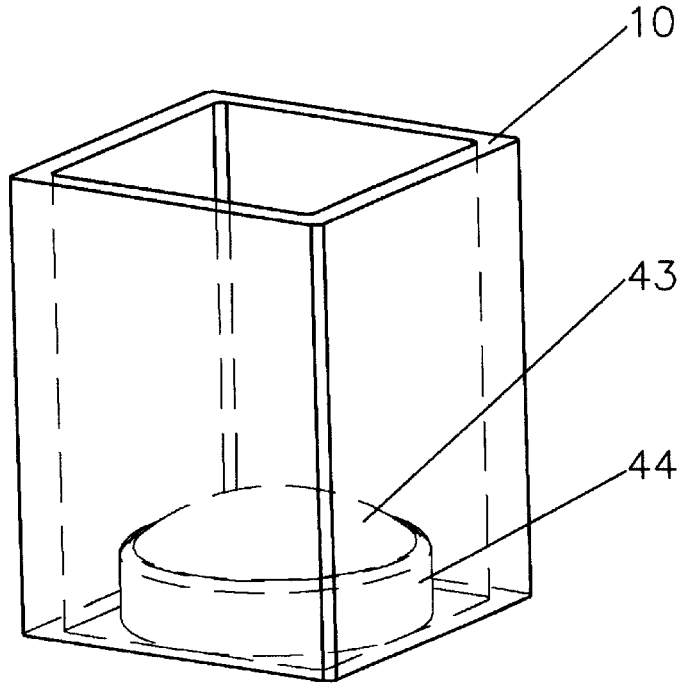
FIG. 10 is a front perspective view of another embodiment of a tetrahedral candle lamp wax encasement element.
Figure 11:
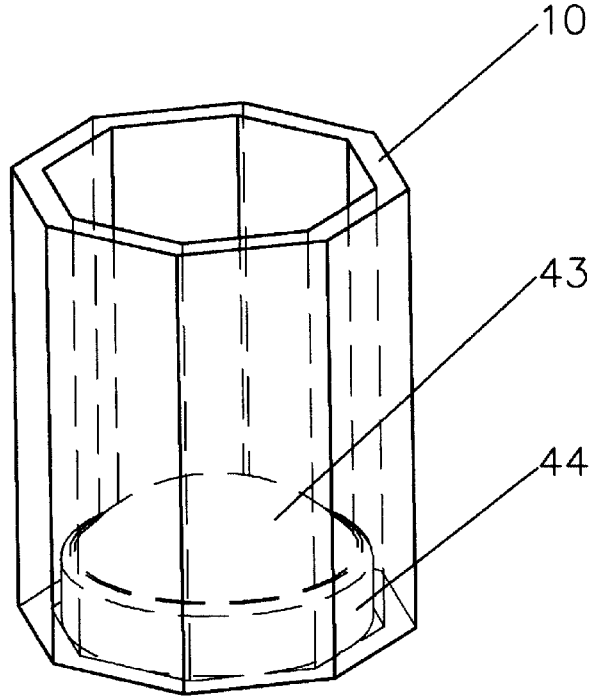
FIG. 11 is a front perspective view of another embodiment of a polyhedral candle lamp wax encasement element.

Referring to the drawings, FIG. 1 illustrates a solid wax encasement element 10 having in this illustrated embodiment a cylindrical shape with a hollow body open top 12 and an open bottom 14. The encasement element 10, in other embodiments, can have a tetrahedral shape or polyhedral shapes all with hollow bodies and open ends. The encasement element 10 can be fabricated from wax, preferably paraffin wax, and is of a thickness to appear translucent when a light source is place within the encasement element 10. The encasement element 10 having a wall 16 thickness of substantially one and one half centimeters to two and one half centimeters with an outside diameter of between twelve to thirteen centimeters allows a translucent appearance when an internal light source is provided. In a fabrication process, the encasement wall 16 is enhanced with embedded decorative objects 18 such as dried, silk or paper flowers or a combination thereof In addition, embedded decorative objects 18 related to holidays or festive occasions can be used and, also, theme objects such as sport symbols or children's toys supply interesting decorative objects.

In FIG. 1, an electrical cord exit notch 20 at the base of encasement element 10 is illustrated. An electrical cord 21 is a component of a solid wax base insert element 22 as illustrated in FIG. 2. The base insert element 22 is a diameter just one to two millimeters less than an encasement element 10 inner wall 24 diameter so that the base insert element 22 can be slidingly inserted into the bottom opening 14 of the encasement element 10. Since the base insert element 22 has a slightly irregular exterior wall, some adhesion between the base insert element 22 and the encasement element 10 inner wall 24 occurs. The solid wax base insert element 22 is comprised of a centrally disposed electrical light socket 26 embedded in a preformed inverted truncated cone aperture 28 (as shown in FIG. 4) to fit tightly within the solid wax base insert element 22 so that a low wattage, low heat light bulb 30 inserted in the light socket 26 will be immovable thereby preventing heat damage to the encasement element 10. The electrical cord 21 having on off switching means 34 exits from the light socket 26 through the solid wax base insert element 22 arriving at a bottom elongated opening 36 as illustrated in FIG. 3 and then can proceed to a source of external electricity such as a 110 volt electrical outlet. The elongated opening 36 allows the electric cord 21 to lie above the wax base insert element 22 flat bottom 38 which rests solidly and safely on a flat surface.

FIG. 4 is a longitudinal sectional view of an assembled convertible candle lamp 40 comprising the solid wax base insert element 22 as illustrated in FIG. 2 inserted into the encasement element 10 as illustrated in FIG. 1. It can be seen that the wax base insert element 22 bottom 38 and the encasement element wall 16 bottom are aligned to form a flat, smooth bottom surface.

FIG. 5 is a top view of the assembled convertible candle lamp 40 showing mainly an interface 42 between the wax encasement element 10 inner wall 24 surface and the solid wax base insert element 22 outer wall surface. The solid wax composition of these adjacent surfaces provides a means for easy wax base insert element 22 insertion and adhesion after the insertion providing a single structure. Also, the electric cord 21 extends through the elongated opening 36 and then through notch 20 combining the two elements into one unit.

In order to convert the convertible candle lamp to a battery operated light source, the solid wax base element 22 is slipped out of the open bottom 14 of the solid wax encasement element 10 and replaced by a battery operated push lamp 43 with a base 44. The battery operated push lamp 43 base 44 has a diameter equal to the solid wax base insert element 22 diameter so easy insertion into and removal from the wax encasement element 10 occurs. Push lamps are well known and commonly found in electrical supply shops. FIG. 6 illustrates a longitudinal section of the convertible candle lamp 40 with the battery operated push lamp 43 as a light source. The push lamp 43 provides a soft, cool, glowing light that leaves the impression of candle light when viewed from the outside of the solid wax encasement element 10. As can be seen in FIG. 6, a bottom surface of the battery operated push lamp 43 base 44 where batteries are accessed is aligned with the solid wax encasement 10 wall 16 bottom surface so a flat lamp base results. Conversion from the electrical outlet light source as provided in the solid wax insert element 22 to the push lamp 43 battery operated light source can be completed in a few minutes.

FIG. 7 illustrates a top view of another embodiment of the convertible candle lamp 40. In this embodiment, the convertible candle lamp uses a candle light source such as a votive or tealight candle. A solid wax base 46 is fitted with a ceramic tile 48, the solid wax base 46 having a diameter equal to the solid wax base insert 22. Here, again, the wax encasement element 10 wall 16 inner surface is adjacent to the tile associated solid wax base 46 outer surface for easy insertion into and removal out of the solid wax encasement element 10. A votive or tealight candle rests on the ceramic tile 48 so any wax drips fall on the ceramic tile 48 to provide a safe candle lamp environment.

The solid wax base 46 fitted with ceramic tile 48 along with the solid wax base insert 22 fitted with light socket 26 and the push lamp 43 comprise three wax encasement element 10 insert means that provide light sources for the convertible candle lamp.

The wax encasement element 10 is fabricated from paraffin wax heated to a liquid state as a temperature between 175° F. and 200° F. A small amount of microcrystalline wax is added to provide a liquid paraffin wax solution. This addition prevents wax cracking upon hardening. For 0.454 kg. of paraffin wax, one teaspoon of microcrystalline wax is needed. A mold is prepared from one cylinder inserted into another cylinder leaving a space between cylinders of about one and one half to two and one half centimeters. In this space, objects are inserted and moved to desired positions so that the finished wax encasement element 10 displays the objects in an attractive manner. The inner cylinder can be moved to accommodate objects of varying sizes and then returned to a position equal distant from the outer cylinder. The inner mold surfaces are sprayed with a lubricant such as Teflon. Then the wax solution is slowly poured in the mold space to the mold top, allowed to settle and then more liquid wax solution is added to bring the liquid wax solution to the mold top. The prepared mold is allowed to cool at about 35° to 40° F. for five or six hours. When the wax is thoroughly hardened the wax forms simply slip out of the mold and are ready for use. Along with the wax encasement element 10, the solid wax base 46 and the solid wax base insert 22 are also prepared. While preparing the encasement element 10, the wax solution is also poured inside a central cavity of the inner cylinder to a height of about two to three centimeters and allowed to cool. A resulting solid wax base can be fitted with a ceramic tile for votive candle placement or drilled to accommodate an electric light socket. Because of this molding method, the solid wax base is correctly sized to exactly fit into and slip out of the wax encasement element 10. When the convertible candle lamp 40 is completed, the wax encasement element 10 and the solid wax base insert 22 bottoms are aligned.

It should be understood that the present invention is not limited to illustrations and certain embodiments and versions described and shown herein, which are deemed to be merely illustrative of the best and preferred modes of carrying out the invention, and which are susceptible to other versions in regard to arrangement of parts, form, size and mode of operation. Therefore, the present invention is intended to encompass all such versions which are within its spirit and scope as defined by the appended claims.

What is claimed is:

1. A convertible candle lamp comprising:

a cylindrical wax encasement element having an open top end and an open bottom end and a wall with a thickness that allows a translucent appearance when an inner light source is provided and having decorative objects embedded in said wall, said wall having a base located electric cord exit notch;

a base insert element slidingly inserted into said open bottom end of said wax encasement element, said base insert element fabricated of wax to a diameter just slightly less than an encasement element inner wall diameter and said base insert element having a centrally disposed inverted truncated cone aperture to receive an electrical socket for light bulb retention and having a bottom surface elongated opening for electric cord exit through said wall base located electric cord notch to an external electrical power source;

said base insert element replaced by slidingly removing said base insert element from said wax encasement element open bottom and inserting into said wax encasement element open bottom, a battery operated push lamp having a diameter equal to said base insert element diameter; and said base insert element replaced by slidingly removing said base insert element from said wax encasement element open bottom and inserting into said wax encasement element open bottom a solid wax base fitted with a ceramic tile on its top surface and having a diameter equal to said base insert element diameter.

2. The convertible candle lamp of claim 1 wherein said wax encasement element has a tetrahedral shape.

3. The convertible candle lamp of claim 1 wherein said wax encasement element has a polyhedral shape.

* * * * *